US009427643B2

(12) United States Patent
Kidd, III et al.

(10) Patent No.: US 9,427,643 B2
(45) Date of Patent: Aug. 30, 2016

(54) BALL HURLING TARGET GAME AND ASSOCIATED APPARATUS

(71) Applicants: William F. Kidd, III, Setauket, NY (US); Andrew E. Matthews, Setauket, NY (US)

(72) Inventors: William F. Kidd, III, Setauket, NY (US); Andrew E. Matthews, Setauket, NY (US)

(73) Assignee: William F. Kidd, III, Setauket, NY (US)

( * ) Notice: Subject to any disclaimer, the term of this patent is extended or adjusted under 35 U.S.C. 154(b) by 0 days.

(21) Appl. No.: 14/340,759

(22) Filed: Jul. 25, 2014

(65) Prior Publication Data

US 2015/0031480 A1 Jan. 29, 2015

Related U.S. Application Data

(60) Provisional application No. 61/859,023, filed on Jul. 26, 2013.

(51) Int. Cl.
*A63B 63/00* (2006.01)
*A63B 67/00* (2006.01)

(52) U.S. Cl.
CPC ..... *A63B 63/00* (2013.01); *A63B 67/002* (2013.01); *A63B 59/20* (2015.10); *A63B 60/50* (2015.10); *A63B 2063/002* (2013.01); *A63B 2210/50* (2013.01); *A63B 2225/093* (2013.01)

(58) Field of Classification Search
CPC ..... A63B 63/00
USPC ..... 473/478, 513, 510; 273/400
See application file for complete search history.

(56) References Cited

U.S. PATENT DOCUMENTS 1,211,379 A * 1/1917 Maisch ..... A63F 9/02 273/368
1,419,554 A * 6/1922 Ganse ..... A63B 67/002 273/400
2,008,359 A * 7/1935 Lamb ..... A63F 9/0208 273/342
D307,616 S * 5/1990 Kelly ..... D21/702
4,936,578 A * 6/1990 Hudson, Sr. ..... A63B 63/00 273/402
5,018,746 A * 5/1991 Cardoza, Jr. ..... A63B 67/002 473/474
5,112,023 A * 5/1992 Sowers ..... A63B 63/083 248/519
6,299,570 B1 * 10/2001 Lim ..... A63B 21/00047 434/248
6,736,738 B1 * 5/2004 Taa ..... A63B 63/008 273/402
6,834,858 B1 * 12/2004 Reineke ..... A63B 63/00 273/400
7,011,310 B2 * 3/2006 Rowan ..... A63B 63/00 273/398
7,288,033 B1 * 10/2007 Jordan ..... A63B 63/00 473/439
8,900,076 B1 * 12/2014 Shropshire ..... A63B 69/002 273/400
2005/0143202 A1 * 6/2005 Orlowski ..... A63B 65/12 473/509
2006/0066054 A1 * 3/2006 Menendez ..... A63B 67/06 273/348
2007/0284825 A1 * 12/2007 Blagg ..... A63F 9/0243 273/359
2011/0089640 A1 * 4/2011 Pecherski ..... A63F 9/06 273/400
2015/0031480 A1 * 1/2015 Kidd, III ..... A63B 63/00 473/478

* cited by examiner

*Primary Examiner* — Gene Kim
*Assistant Examiner* — M Chambers

(57) ABSTRACT

A game for at least 2 players wherein one of the players attempts to score points by hurling a plastic ball with the aid of a scoop racket into one of three scoring areas of their opponents "goal". Opposing players stand at opposite ends of a playing field with said goal(s) positioned in front of each player. Goals are situated a certain distance apart from each other, the three scoring areas are mounted at adjustable heights above the playing surface and can be positioned in a common plane (or not). Said scoring areas are of various diameters and point values. Said scoring areas are distinctly apart from each other (not abutted) and are attached to a fixed post (standard). Points are awarded to players for hurling the ball into one of their opponent's scoring areas with point values inversely proportional to the diameter of the scoring area scored upon.

5 Claims, 5 Drawing Sheets

BALL HURLING TARGET GAME AND ASSOCIATED APPARATUS

CROSS-REFERENCE TO RELATED APPLICATIONS

This application claims the benefits of, and priority to, U.S. Provisional Patent Application No. 61/859,023, filed on Jul. 26, 2013, the entire contents of which are herby incorporated herein by reference.

BACKGROUND OF THE INVENTION

The present invention relates to an apparatus and a method of play for a game which is played by hurling a ball using the aid of a racket at each of two "goals" in turn by each of two players on opposite teams or four players which are divided into two two-player teams.

BACKGROUND OF THE INVENTION

In U.S. Pat. No. 3,026,110 (Hess et al); U.S. Pat No. 3,596,909 (Russ); U.S. Pat. No. 3,895,801 (Baird), U.S. Pat. No. 5,382,028 (Sciandra et el), U.S. Pat. No. 4,168,066 (Sole et al), U.S. Pat. No. 257,779 (Sippola), U.S. Pat. No. 4,635,943 (Lumpkin), U.S. Pat. No. 410,498 (Decker), U.S. Pat. No. 5,944,318 (Payton) and U.S. Pat. No. 4,378,944 (Johnston). Each of these patents employs a projectile being propelled at a target in an attempt to score point. However, there is no disclosure or showing for a ball being hurled at a target using a racket.

In U.S. Pat. No. 4,168,066 issued (September 1979) to Sole et al, discloses a projectile that is propelled in an attempt to score in one of numerous (three or four) hoops respectively, mounted in a common plane. U.S. Pat. No. 4,168,066 is also similar in that it uses 3 targets of different sizes and point values. However, U.S. Pat. No. 4,168,066 is different from the applicant's invention in that only a single goal is used that is positioned midway between opposing players and said goal is designed to allow a disc to glide through the openings. The applicant's invention employs the use of 2 goals that are positioned in front of each opponent. Each goals also employs three targets that are arranged in a specific pattern, however, each target is distinctly separated from each other and fitted with a netting material designed to catch on hold the projectile being thrown.

In U.S. Pat. No. 5,382,028 issued (January 1995) to Sciandra et al (KAN JAM) is similar in that there is a "goal" which is positioned in front of each opposing player and multiple ways of scoring points, however, this patent employs a different shaped goal and a disc shaped projectile thrown with a players hand rather than a round plastic projectile which is hurled at the goal with the use of a racket/scoop.

In U.S. Pat. No. 5,944,318, issued (August 1999) to Payton, discloses a square target game apparatus that includes a net to retain the thrown projectile similar to the applicant game. However, the target is meant to be used by an individual player and is designed for a disk shaped projectile.

In U.S. Pat. No. 6,834,858, issued (Dec. 28, 2004) to Reineke, discloses a low cost single target that employs a ring shaped target fitted with a net that is readily assembled and disassembled. However, the target relates to flying disc targets that are particularly suited to playing "Frisbee golf"

In U.S. Pat. No. 7,011,310, issued (March 2006) to Rowan, discloses a multidimensional interchangeable ball game apparatus, which can be used for throwing, kicking or hitting with any type of ball sport. This apparatus employs multiple targets of multiple sizes and can be used with open or closed nets. However, this invention discloses a single goal apparatus which is used for practice purposes to enhance the skills of a single player and is not used in game play situations. The applicant's invention uses multiple targets of various sizes but is used in conjunction with game play putting 2 opponents against one another.

The art abounds in targets designed to catch flying objects that are thrown or propelled at targets. Targets that have a net held open by a frame wherein the flying object is propelled or thrown into the net is used for a diversity of purposes. Well know games such as basketball, and hockey, employ such goals as targets. Most of these targets are designed to improve the skills of a single player and cannot be used in game play with 2 opposing players.

In U.S. Pat. No. 7,850,551, issued (December 2010) to Barber, discloses a mobile practice target to be used with thrown projectiles to enhance throwing skills, in particular, the sport of football. However, it does not disclose the use of a ball being hurled with the aid of a racket.

In U.S. Pat. No. 5,395,122, issued (March 1995) to Kreamer, discloses a single target having a conical net and supported by an upright standard connected to a receiver driven into the ground.

In U.S. patent application Ser. No. 10/906,675 (March 2005) issued to Remaklus (sports training apparatus and method of using the same) discloses a single net/ring shaped target to be used by an individual as a training/practice tool for sports such as volleyball and basketball.

In U.S. Pat. No. (5,692,979) (multipurpose game device) issued on (December 1997), to Jones discloses a series of webbed hoops located at the tops of numerous standards.

In U.S. Pat. No. (6,659,466), issued on (December 2003) to Searles et al, discloses a throwing game and goal. However, this goal and game was intended to be used with a flying disc or Frisbee.

In U.S. Pat. No. 4,673,186, issued (June 1987), to Walker, discloses the use of a stick to propel a spherical wooden ball (with holes in it) through a horizontal basket (hoop).

In U.S. Pat. No. 7,090,596, issued on (August 2006) to David discloses an open target hoop attached to a horizontal member which is positioned above the ground in which a player attempts to throw a projectile (i.e. football) though the target loop to a person on the other side.

In U.S. Pat. No. 7,401,785 , issued in 2007 to Waite discloses a single target which contains scoring areas with different point values and collecting pockets to be used when a person uses an underhand toss. The game was intended to be played with bean bags.

While each of the aforementioned patents disclosed games which involve projectiles being thrown through the air at a target or scoring area, none are believed to use a racket or scoop to hurl a round projectile into a uniquely designed scoring target.

None of the above inventions and patents taken either singly or in combination, is seen to describe the instant invention as claimed.

The inventor's intent is a target catching assembly intended for the opposing player to be in the field of play from behind the target, whereas the target itself creates game excitement to the players by challenging them to score in the targets (while on offense) and at other times reacting to and catching deflected and missed targeted balls (while on "defense").

BRIEF SUMMARY OF THE INVENTION

This game is played primarily outdoors in backyards, beaches, driveways or parking lots but can be played indoors in areas where there is plenty of room, (for example, school gymnasiums). This game is designed 2 players which stand on opposite ends of the field, or 4 players, with teammates standing on the same end of the field but opposite their opponents (or one teammate on each side depending on game variation). When playing with 4 people teammates alternate shots on the opposing teams.

The game uses two "goals" (each equipped with a base (to allow the goal to be set up on any surface) and three scoring areas (targets)), 2 rackets and a plastic ball. The "goals" are placed at opposite ends of a playing field. Opposing players stand behind each of the goals and players are not allowed to go in front of the goal whether attempting to score on their opponents "goal" or defending balls from going into their "goal".

The start of play is determined by a simple coin toss, or any other starting procedure determined by the players. The winner of the coin toss has the opportunity to shoot the ball first. Whichever team does not shoot first will have the opportunity to get the last shot ("last licks") in an attempt to tie or win the game.

Player 1 hurls the ball using the racket and attempts to score from any area in the playing field as long as the throw is from behind his own goal. The opposing player(s) are required to stand behind their own goal apparatus and are not allowed to interfere (i.e. play defense) with the path of the plastic ball as it approaches the goal. A player is allowed to go in front of their own goal only to retrieve a ball that has landed short. Once a thrown ball has passed the goal apparatus, the opposing player attempts to catch the ball while it is in the air. Players continue to hurl the plastic ball back and forth while attempting to score points by hurling the ball through one of the three targets until enough points have been scored and there is a winner. First player (or team) to score 11 points wins the game. However, if one of the players or teams has achieved a score of 11 and the other team has not had their last turn yet (last licks), then the other team takes their last turn to determine their final score. If they fail to tie or win the game, the game is over. If tied, the game continues in a similar way until a winner is determined.

Additional rules, point scoring and field dimension variations can be applied depending on the skill level of the players. For advanced players, points may also be awarded to the offensive player if the opposing player drops a catchable ball. Similarly, points may also be awarded to any player who catches a thrown ball that has deflected off any part of the goal, or subtracted from the score of the player who has thrown the ball.

Accordingly, it is a principal object of the invention to have a ball hurling game with two goals comprised of 3 scoring areas (targets) and a base, which may be used to play the game on grass in a yard or in a park.

It is another object of the invention to have a ball hurling game with two goals comprised of 3 scoring areas (targets) and a base, which may be used to play the game on sand at the beach.

It is another object of the invention to have a ball hurling game with two goals comprised of 3 scoring areas (targets) and a base, which may be used to play the game on cement/asphalt in a parking lot or driveway, or on wood in an indoor area such as a gymnasium.

It is a further object of the invention to provide the ball hurling game with a spherical ball to be hurled at the goals which have three targets to score points according to which target is scored upon.

Still another object of the invention is to provide a ball hurling game which is played by two players or four players (or more) that are divided into two even teams.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

DETAILED DESCRIPTION OF THE INVENTION

Figure 1:
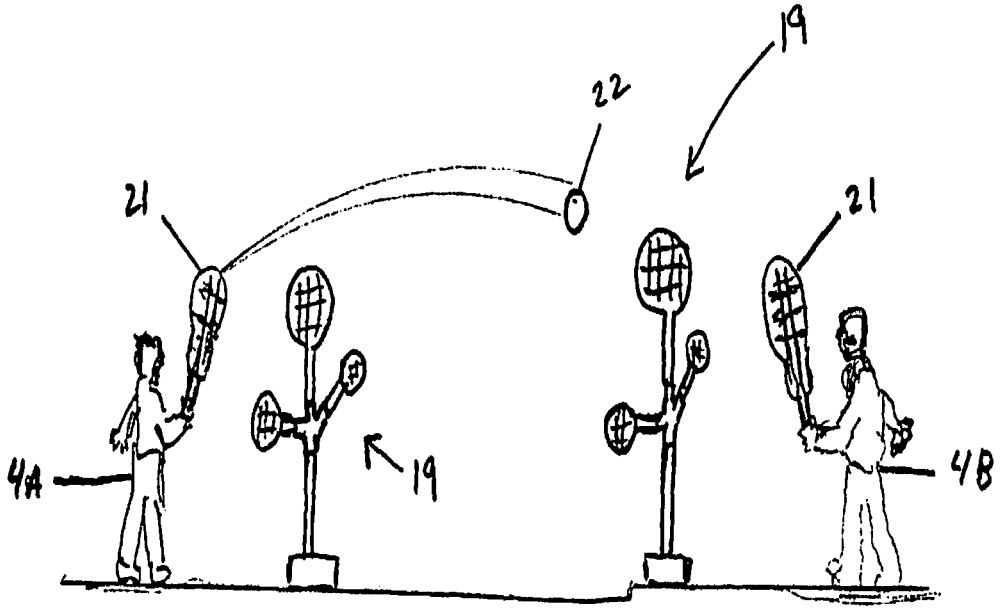
FIG. 1 is an overall perspective view of a field game being played using the preferred apparatus of the present invention.

The present invention, generally shown in FIG. 1 is a ball hurling game 26 which is played with a ball, a racket for each player, and two goals (each comprised of three nets or scoring areas) which are positioned on front of each player at opposite sides of a field. The game 26 is played by 2 players UA and UB. However, the game 26 may also be played by four players in two teams of two players (not shown) This game can be played outdoors or indoors wherever there is a lot of room, e.g., in a gymnasium. Goals 19 may be made of any suitable material such as plastic or aluminum while rackets 21 and the ball 22 are preferably made from a plastic material. The opposing player (s) 4A and 4B are required under most circumstances and variations to stand behind their own goal apparatus 19 and are not allowed to interfere with the path of the plastic ball 22 while it is in front of their goal 19. (A player (or players) is only allowed to go in front of their own goal to retrieve a ball 22 that has been thrown short or attempting to catch a ball which has deflected of the goal apparatus 19). Once a thrown ball 22 has passed the goal apparatus 19, the opposing player then must catch the ball while it is in the air.

Figure 2:
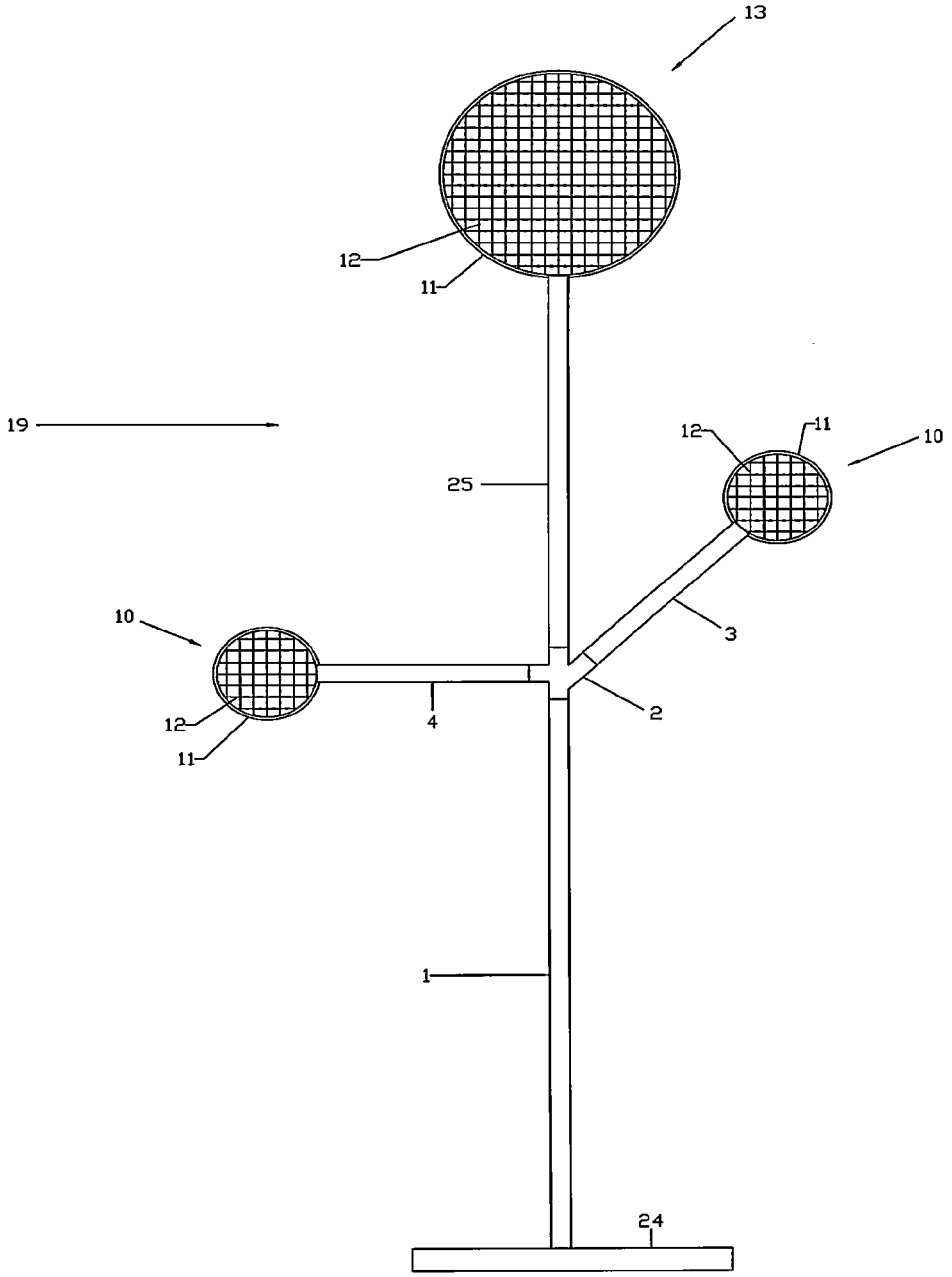
FIG. 2 is a perspective view of the preferred embodiment of the goal apparatus showing assembled parts (front view).
Figure 3:
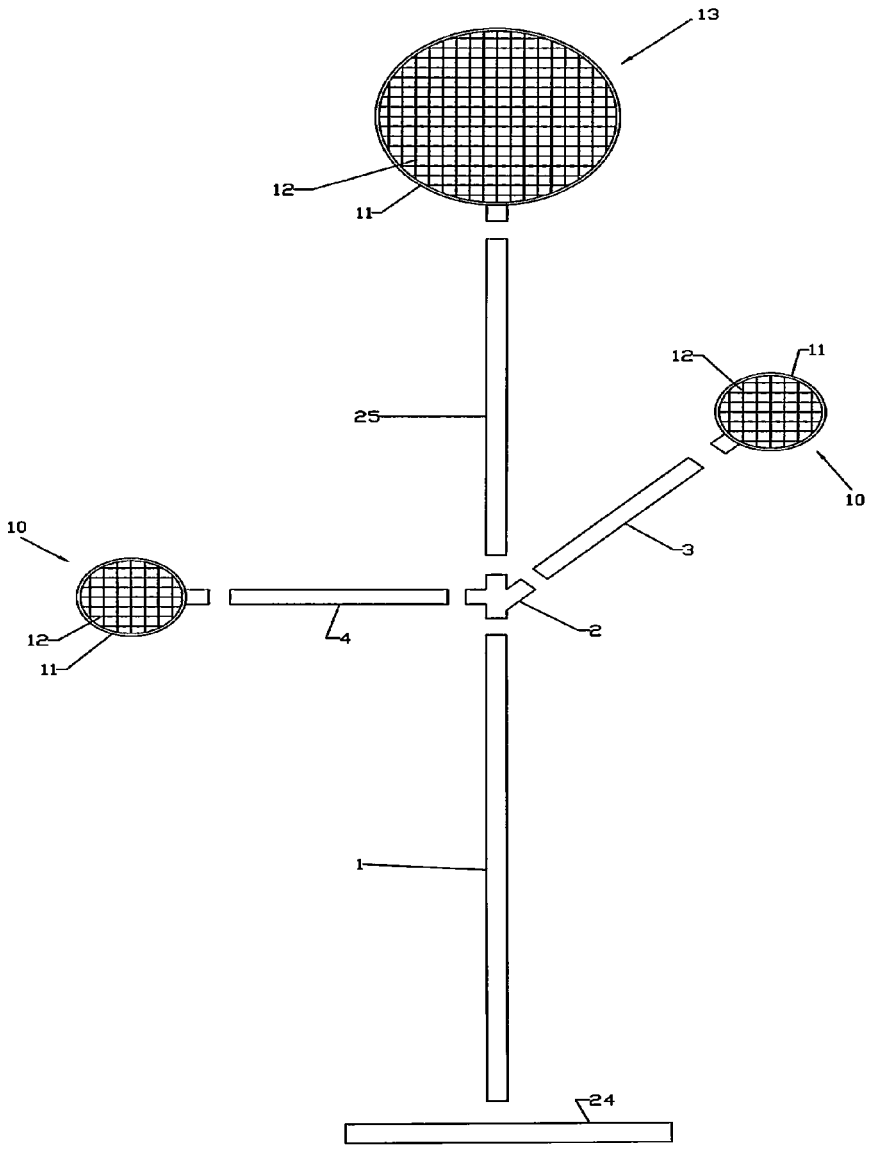
FIG. 3 is an exploded view of the preferred embodiment of the goal apparatus showing assembled parts (front view).

Referring now to FIGS. 2 (front view) and 3 (exploded view) in the present invention which represents the preferred embodiment of the goal 19. The targets or scoring areas are positioned a certain height above the ground by a 48" standard 1. This standard 1 is composed of plastic, aluminum or other similar material. The standard 1 may be inserted vertically into a plastic base 24.which may be filled with sand or water which will allow goal 19 to stand upright on any surface (e.g. sand, grass, concrete etc). In its preferred arrangement, the top of the standard 1 is inserted into a 4-way "cross" fitting 2. The 4-way "cross" fitting 2 contains three 90 degree angles and one 45 degree angle. The cross is inserted into the standard 1 so that there is a 90 angle to the left side; a 45 degree angled opening pointing upwards to the right, and an opening directly above the standard 1. Inserted into the left opening of the 4-way "cross" fitting is a 15" pipe extension 4. The extension is composed of plastic, aluminum or other similar material and acts like an arm and extends outward in a horizontal direction from the standard. Inserted into this extension is a small 20 cm diameter target 10. The target has a 0.5" diameter frame 11 composed of either aluminum or plastic and is designed to maintain the rigidity of the goal. In its basic form and arrangement, attached to the frame is 1" see-through nylon mesh 12, which is used to "catch" the thrown ball. On one side of the 4-way "cross" fitting and inserted into the 45 degree opening is a 15" length of pipe 3. The pipe is composed of plastic, aluminum or other similar material and extends outward from the standard 1 and points in a generally 45 degree upwards direction. Attached at the end of this "arm" is a small 20 cm diameter target 10 similar to the one mentioned above. This target has a 0.5" diameter frame 11 composed of either aluminum or plastic and is designed to maintain the rigidity of the goal. Attached to the frame is 1" see-through nylon mesh 12, which is used to "catch" the thrown ball. The 2 small 20 cm diameter targets 10 extend outward from the main standard 1 and are located in a similar plane.

On the top opening of the 4-way "cross" is inserted a 15" length of pipe 25. The extension is composed of plastic, aluminum or other similar material and acts like an arm and extends upwards in a vertical direction from the standard. Into the open end of this pipe 25 is inserted a large 45 cm diameter target 13. This goal has a similar frame 11 and see-through nylon mesh netting 12 as the two smaller nets.

Figure 4:
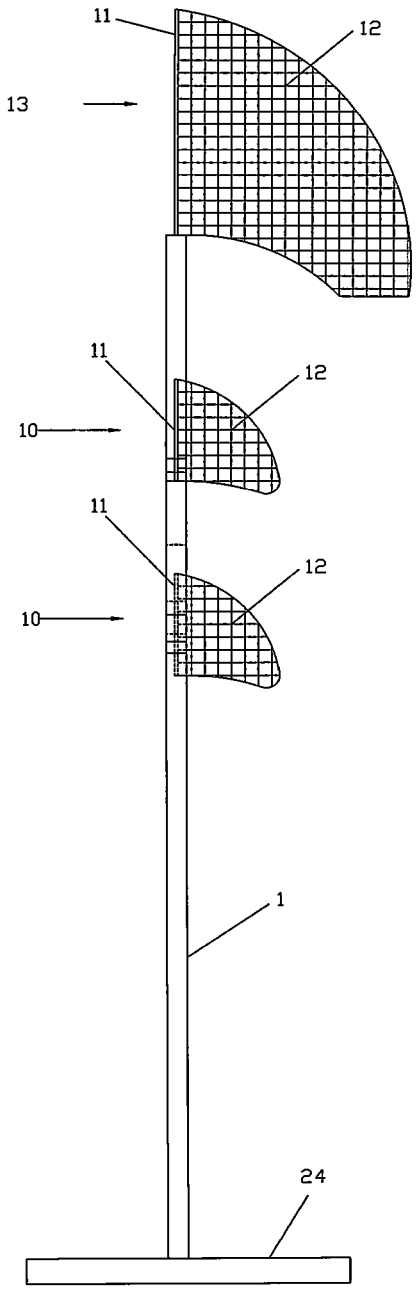
FIG. 4 is a perspective view of the preferred embodiment of the goal apparatus showing assembled parts (side view).

Referring to FIG. 4, the larger goal 13 is positioned higher than the other two goals 10 and is positioned in a common plane with the two smaller goals 10.

Figure 5:
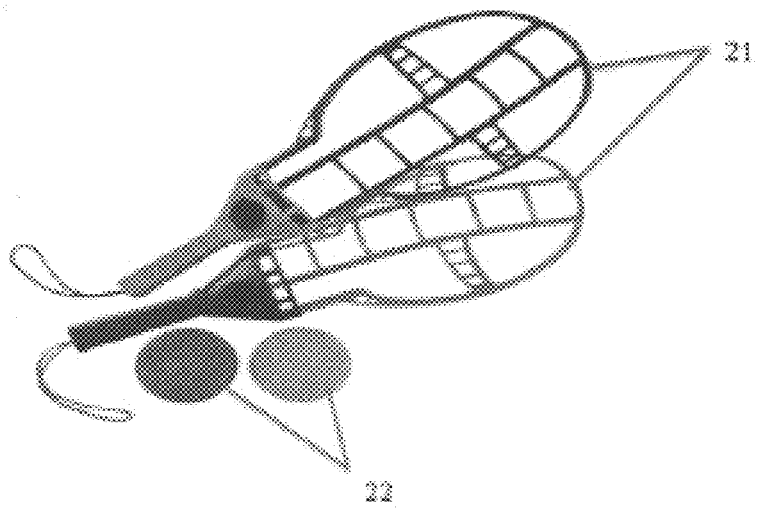
FIG. 5 is a perspective view of a preferred embodiment of the racket and ball (prior art (U.S. Pat. No. 4,045,026)).

Referring to FIG. 5, which shows the preferred embodiment of the racket 21 and of the ball 22. The preferred thermoplastic racket is the same or similar design and construction as the racket described in prior art U.S. Pat. No. 4,045,026. The racket is specifically designed with tracks to generate friction with the ball so that when the ball is thrown it will have "spin" and allow it to curve on one direction or the other. The preferred thermoplastic blown ball is the same or similar design and construction as the ball used in prior art U.S. Pat. No. 4,045,026. The ball is specifically designed to curve in a certain direction based on the spin put on the ball by the players throwing motion. The ball can be made to "curve" left or right or rise or drop based on the players throwing motion.

Figure 6:
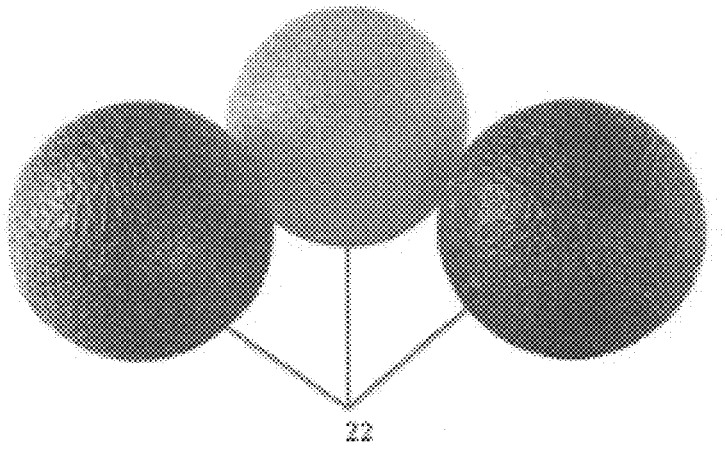
FIG. 6 is an enlarged perspective view of a preferred embodiment of the ball (prior art (U.S. Pat. No. 4,045,026)).

Referring to FIG. 6, which shows an enlarged view of the preferred embodiment of the ball 22.

We claim:

1. A projectile throw and target game for 2 (or more) players, comprising:

a first goal consisting of 3 hoops which serve as targets;

said goal, wherein the one large hoop target of predetermined diameter (533 mm) is attached to a support post in a vertical position and is located highest above the ground;

said goal, wherein the this large centered hoop target being sized 5.5-6.5 times the diameter of the specified game ball;

said goal, wherein the support post to have a rounded front forward facing profile (as opposed to a flat profile) to increase deflections to areas that are located behind the goal thus making deflected balls catchable, and which reduce to the greatest extent possible direct hits which would deflect the specified ball in front of the goal and into the restricted area, thus making those deflected balls uncatchable;

said goal, wherein the two smaller hoop targets of predetermined diameter (305 mm) are attached part way up the support post on opposing sides and in vertical positions;

said goal, wherein these smaller left and right positioned hoops being sized 3.1-3.7 times the diameter of the specified game ball;

said goal, wherein one of the smaller hoop targets will be attached to a short arm extending out (457 mm) from the support pole at a 90 degree angle;

said goal, wherein the small arm extending out at a 90 degree angle to have a rounded front forward facing profile (as opposed to a flat profile) to increase deflections to areas that are located behind the goal thus making deflected balls catchable, and which reduce to the greatest extent possible direct hits which would deflect the specified ball in front of the goal and into the restricted area, thus making those deflected balls uncatchable;

said goal, wherein the other small hoop target will be attached to a short arm and extend out (457 mm) from the support pole at a 45 degree angle in an upward direction;

said goal, wherein the small arm extending at a 45 degree angle in an upward direction to have a rounded front forward facing profile to increase deflections (as opposed to a flat profile) to increase deflections to areas that are located behind the goal thus making deflected balls catchable, and which reduce to the greatest extent possible direct hits which would deflect the specified ball in front of the goal and into the restricted area, thus making those deflected balls uncatchable;

said goal, wherein the hoops may be elevated to an adjustable height above the ground dependent on the height of the players and the throwing preference of the defending player;

a second goal consisting of 3 hoops that serve as targets;

said goal, wherein the one large hoop target of predetermined diameter (533mm) is attached to a support post in a vertical position and is located highest above the ground;

said goal, wherein the this large centered hoop target being sized 5.5-6.5 times the diameter of the specified game ball;

said goal, wherein the support post to have a rounded front forward facing profile (as opposed to a flat profile) to increase deflections to areas that are located behind the goal thus making deflected balls catchable, and which reduce to the greatest extent possible direct hits which would deflect the specified ball in front of the goal and into the restricted area, thus making those deflected balls uncatchable;

said goal, wherein the two smaller hoop targets of predetermined diameter (305 mm) are attached part way up the support post on opposing sides and in vertical positions;

said goal, wherein these smaller left and right positioned hoops being sized 3.1-3.7 times the diameter of the specified game ball;

said goal, wherein one of the smaller hoop targets will be attached to a short arm extending out (457 mm) from the support pole at a 90 degree angle;

said goal, wherein the small arm extending out at a 90 degree angle to have a rounded front forward facing profile (as opposed to a flat profile) to increase deflections to areas that are located behind the goal thus making deflected balls catchable, and which reduce to the greatest extent possible direct hits which would deflect the specified ball In front of the goal and into the restricted area, thus making those deflected balls uncatchable;

said goal, wherein the other small hoop target will be attached to a short arm and extend out (457 mm) from the support pole at a 45 degree angle in an upward direction;

said goal, wherein the small arm extending at a 45 degree angle in an upward direction to have a rounded front forward facing profile (as opposed to a flat rectangular profile) to increase deflections to areas that are located behind the goal thus making deflected balls catchable, and which reduce to the greatest extent possible direct hits which would deflect the specified ball in front of the goal and into the restricted area, thus making those deflected balls uncatchable;

said goal, wherein the goal may be elevated an adjustable height above the ground dependent on the height of the players;

a first racket composed of thermoplastic material for throwing, catching and cradling projectiles;

said racket; having an oversized head for aiding the cradling and catching of fast deflections of the specified ball;

said racket, with firm plastic track to put aerodynamic spin on specified ball;

said racket, to enable the thrower to change the angle and speed of the ball thereby making non-scoring defecting throws more difficult to catch;

said racket, with firm plastic basket to deflect specified ball to oneself with oversized racket to reduce it's lateral speed and increase the chances of catching specified ball by "popping it up" to oneself;

said racket, incorporating a handle means with a grooved surface;

said racket, incorporating a strap means attached to the handle;

said racket, incorporating a projectile cradling section connected to the handle;

said racket, incorporating an oblong scoop for throwing and catching projectiles connected to the cradling section, the scoop having an opening at its base (just large enough to contain the specified game ball), leading to the cradling section which has a width between 165 mm and 216 mm and length between 203 mm and 330 mm, a completely open front, and substantially open sides and back;

said racket, incorporating a rigid frame of thermoplastic material defining the perimeter of the scoop comprising;

said racket, incorporating a rim defining the periphery of the front of the scoop with a perpendicular side flange projecting towards the back of the scoop;

said racket, incorporating a spherical projectile engaging tracks extending along the back of the scoop for substantially the entire length of the scoop, terminating at the front portion of the rim most remote from the handle, with at last a portion of each of the two tracks having a serrated surface;

said racket, wherein serrated tracks are spaced no less than 50 mm apart and no more than 83 mm apart;

said racket, incorporating a plastic mesh members extending between the rim and the tracks;

said racket, incorporating an irregular transverse surface on the front face of the portion of the rim where the tracks terminate whereby when used to launch a spherical projectile, the curvature of the trajectory of the projectile is maximized;

said racket, wherein the tracks with a serrated surface are substantially parallel;

said racket, wherein the tracks with a serrated surface have a plurality of triangular saw toothed projections along at least a portion thereof;

said racket, wherein the spacing of the tracks engages said projectile in both hemispheres whereby a high degree of spin is imparted to the projectile launched by said receptacle to thereby impart a degree of curvature to the trajectory of the projectile corresponding to the degree of spin;

a second racket composed of thermoplastic material for throwing, catching and cradling projectiles;

said racket; having an oversized head for aiding the cradling and catching of fast deflections of the specified ball;

said racket, with firm plastic track to put aerodynamic spin on specified ball;

said racket, to enable the thrower to change the angle and speed of the ball thereby making non-scoring defecting throws more difficult to catch;

said racket, with firm plastic basket to deflect specified ball to oneself with oversized racket to reduce its lateral speed and increase the chances of catching specified ball by "popping it up" to oneself;

said racket, incorporating a handle means with a grooved surface;

said racket, incorporating a strap means attached to the handle;

said racket, incorporating a projectile cradling section connected to the handle;

said racket, incorporating an oblong scoop for throwing and catching projectiles connected to the cradling section, the scoop having an opening at its base (just large enough to contain the specified game ball), leading to the cradling section which has a width between 165 mm and 216 mm and length between 203 mm and 330 mm, a completely open front, and substantially open sides and back;

said racket, incorporating a rigid frame of thermoplastic material defining the perimeter of the scoop comprising;

said racket, incorporating a rim defining the periphery of the front of the scoop with a perpendicular side flange projecting towards the back of the scoop;

said racket, incorporating a spherical projectile engaging tracks extending along the back of the scoop for substantially the entire length of the scoop, terminating at the front portion of the rim most remote from the handle, with at last a portion of each of the two tracks having a serrated surface;

said racket, wherein serrated tracks are spaced no less than 50 mm apart and no more than 83 mm apart;

said racket, incorporating a plastic mesh members extending between the rim and the tracks;

said racket, incorporating an irregular transverse surface on the front face of the portion of the rim where the tracks terminate whereby when used to launch a spherical projectile, the curvature of the trajectory of the projectile is maximized;

said racket, wherein the tracks with a serrated surface are substantially parallel;

said racket, wherein the tracks with a serrated surface have a plurality of triangular saw toothed projections along at least a portion thereof;

said racket, wherein the spacing of the tracks engages said projectile in both hemispheres whereby a high degree of spin is imparted to the projectile launched by said receptacle to thereby impart a degree of curvature to the trajectory of the projectile corresponding to the degree of spin;

a spherical projectile composed of polyethylene plastic material;

said spherical projectile, consisting of a hollow ball of a predetermined diameters (82 mm-96 mm) and predetermined masses (21 g-41 g);

said spherical projectile, wherein the projectile has a plurality of patterned raised ridges evenly spaced and distributed across the surface area of the ball thereby creating surface friction when thrown, deflected and caught and air friction when hurled and curved;

said spherical projectile, wherein the projectile is evenly weighted across is textured surface and hemispheres to provide even spin and predictability of deflection angle;

said spherical projectile, wherein the projectile is fabricated from a material with a density of from about 1 to about 5 pounds per cubic foot;

said spherical projectile, wherein the projectile is fabricated from blow molded polyethylene.

2. A projectile throw and target game according to claim 1, wherein each goal is made of a PVC plastic support material;

said large hoop target will extend upward above the two smaller hoop targets and will be oriented in a common plane or non-common plane, where said large hoop target will be positioned in a common plane as the two smaller hoop targets or will extend upward and behind the two smaller hoop targets at a 45 degree angle (2 smaller hoop targets in a plane which is forward of the larger hoop target) and allows for increased potential for scoring in the large target, as a thrown ball may be deflected off the forward positioned smaller targets or 45degree angle support arm and into the large target;

said hoop targets, wherein the large hoop target on each goal may be fitted with a small flexible elastic opening at the back end of the netting ("quick ball release") which is sized just slightly smaller than the ball (85 mm) which will contain the ball temporarily, but which when pressured will allow the ball to drop through the netting and be retrieved without having to reach into the target;

said hoop targets are fitted with a "see-through" nylon netting material;

said "see through" netting will allow the opposing player to visually see a thrown projectile from behind the goal as it flies past or into the goal, which will allow the opposing player to make adjustments in positioning to catch a thrown ball which misses the targets, deflects off the goal apparatus, or which on occasion with forcefully thrown balls proceeds through the quick ball release and into the field of play;

said hoop targets have a frame composed of plastic material which provides rigidity to the hoop targets and allows the "see-through" netting to be attached;

said hoop targets, wherein frame is rounded to increase deflections toward areas behind the goal;

said goal contains a standard which may be inserted into a plastic base with "fill opening";

said base, may be manually filled with water or sand, or other material, which will support the goal and allow the goal to stand upright on any hard or soft surface;

said base, shall provide an even surface with rounded angled forward profile such that poorly thrown balls may deflect up off the base and into the field of play and provide a deflection and catch —scoring opportunity to the "catching player".

3. A projectile throw and target game for a plurality of players, comprising:

a plurality of goals wherein each goal comprising a plurality of hoops which serve as targets; wherein one hoop target of predetermined diameter is attached to a support post in a vertical position and whose top edge is located highest above the ground and wherein the support post has a cross-sectional shape having a rounded front forward facing to increase deflections to areas that are located behind the goal thus making deflected balls catchable, said goal, wherein the two smaller hoop targets of predetermined diameter are attached part way up the support post on opposing sides and in vertical positions; said goal, wherein these smaller left and right positioned hoops wherein one of the smaller hoop targets will be attached to a short arm extending out from the support pole at a 90 degree angle from the support post and; wherein the second small hoop target will be attached to a short arm and extend out from the support pole at a 45 degree angle in an upward direction from the support post; and wherein each hoop has a net attached to said hoop for catching a projectile and having:

a plurality of rackets for throwing, catching and cradling said projectiles wherein said rackets are composed of a thermoplastic material and wherein said racket; having an oversized head for aiding the cradling and catching of a projectile and wherein said racket has projectile engaging tracks extending along the back of the scoop for substantially the entire length of the scoop and wherein said racket, incorporating a plastic mesh members extending between the rim and the tracks that projectile and wherein said game has a spherical projectile composed of polyethylene plastic material.

4. A projectile throw and target game according to claim 3, wherein each goal is made substantially of a PVC plastic material.

5. A projectile throw and target game according to claim 3, wherein the hoop target on each goal is fitted with a small flexible elastic opening at the back end of the netting which is sized just slightly smaller than the ball.

* * * * *